US010525737B2

(12) United States Patent
Shibata et al.

(10) Patent No.: US 10,525,737 B2
(45) Date of Patent: Jan. 7, 2020

(54) PARTIALLY DRIED INKJET MEDIA CONDITIONER

(71) Applicant: Hewlett-Packard Development Company, L.P., Houston, TX (US)

(72) Inventors: Alan Shibata, Camas, WA (US); Steve O Ramussen, Vancouver, WA (US); Matthew RaisanenVancouver, Vancouver, WA (US); Jeffrey G Bingham, Vancouver, WA (US); Sam Sing, Vancouver, WA (US); Aurelio Maruggi, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/763,037

(22) PCT Filed: Jan. 15, 2016

(86) PCT No.: PCT/US2016/013734
§ 371 (c)(1),
(2) Date: Mar. 23, 2018

(87) PCT Pub. No.: WO2017/123257
PCT Pub. Date: Jul. 20, 2017

(65) Prior Publication Data

US 2018/0272752 A1 Sep. 27, 2018

(51) Int. Cl.
*B41J 11/00* (2006.01)
*B41M 7/00* (2006.01)

(52) U.S. Cl.
CPC ..... *B41J 11/002* (2013.01); *B41M 7/009* (2013.01); *B41M 7/0054* (2013.01)

(58) Field of Classification Search
CPC .... B41M 7/00; B41M 7/0027; B41M 7/0054; B41J 11/0005; B41J 11/005; B41J 11/0015; B41J 11/0045
See application file for complete search history.

(56) References Cited

U.S. PATENT DOCUMENTS 4,218,026 A * 8/1980 Stange ..... B65H 20/24 226/118.5
5,314,861 A 5/1994 Morohoshi et al.
(Continued)

FOREIGN PATENT DOCUMENTS

JP 2001-301151 10/2001
JP 2002213434 7/2002
(Continued)

OTHER PUBLICATIONS

Svanholm, et al. Dissertation: Printability and Ink coating Interactions in Inkjet Printing. Karlstad University. 2007—58 pages.

*Primary Examiner* — Scott A Richmond
(74) *Attorney, Agent, or Firm* — Brooks Cameron & Huebsch PLLC

(57) ABSTRACT

In one example, a system for a partially dried inkjet media conditioner includes a partially dried Inkjet media conditioner, including: a first connector to couple a first end of the conditioner to a printing device, a second connector to couple a second end of the conditioner to a finishing device, and a constrained path extending through the conditioner to receive partially dried inkjet media from the printing device and provide the partially dried Inkjet media to the finishing device.

15 Claims, 6 Drawing Sheets

(56) References Cited

U.S. PATENT DOCUMENTS

| | | | | |
|---|---|---|---|---|
| 5,788,999 | A * | 8/1998 | Mizuno | B26D 7/1863 425/302.1 |
| 6,513,924 | B1 | 2/2003 | Goldberg et al. | |
| 7,379,703 | B2 | 5/2008 | Ito | |
| 2003/0126962 | A1 | 7/2003 | Bland et al. | |
| 2003/0156176 | A1* | 8/2003 | Miyamoto | B41J 11/0005 347/102 |
| 2004/0231556 | A1 | 11/2004 | Masako et al. | |
| 2006/0051528 | A1 | 3/2006 | Ogino et al. | |
| 2007/0132174 | A1* | 6/2007 | Yamane | B41J 11/0005 271/188 |
| 2009/0214806 | A1 | 8/2009 | Kobayashi | |
| 2009/0255460 | A1* | 10/2009 | Castelli | B41J 11/0015 118/46 |
| 2012/0062637 | A1* | 3/2012 | Wolanski | B41J 3/543 347/16 |
| 2012/0062667 | A1* | 3/2012 | Roof | B41J 11/0015 347/102 |
| 2013/0076843 | A1 | 3/2013 | Tombs et al. | |
| 2013/0113868 | A1* | 5/2013 | Veis | B41J 11/0015 347/102 |
| 2015/0336396 | A1* | 11/2015 | Aihara | B41J 11/0005 347/217 |
| 2015/0367340 | A1 | 12/2015 | Beachner et al. | |
| 2016/0200534 | A1* | 7/2016 | Wang | B65H 5/023 271/265.01 |
| 2016/0370749 | A1* | 12/2016 | Hamada | G03G 15/6576 |

FOREIGN PATENT DOCUMENTS

| | | |
|---|---|---|
| JP | 2006-167967 | 6/2006 |
| JP | 2008-110554 | 5/2008 |

* cited by examiner

PARTIALLY DRIED INKJET MEDIA CONDITIONER

BACKGROUND

Inkjet printers can deposit quantities of printing fluid onto a printable media (e.g., paper, plastic, etc.). In some examples, inkjet printers can create a curl and/or cockle in the printed media when the printing fluid droplets deposited by the inkjet printer are not completely dry. In some examples, a number of physical properties of the printable media can be changed when the printing fluid droplets deposited by the inkjet printer are not completely dry. For example, the stiffness of the printable media can be changed when the printing fluid droplets deposited by the inkjet printer are not completely dry. The curl, cockle, and/or other physical properties that change due to the printing fluid droplets can make finishing processes difficult.

DETAILED DESCRIPTION

Figure 1:
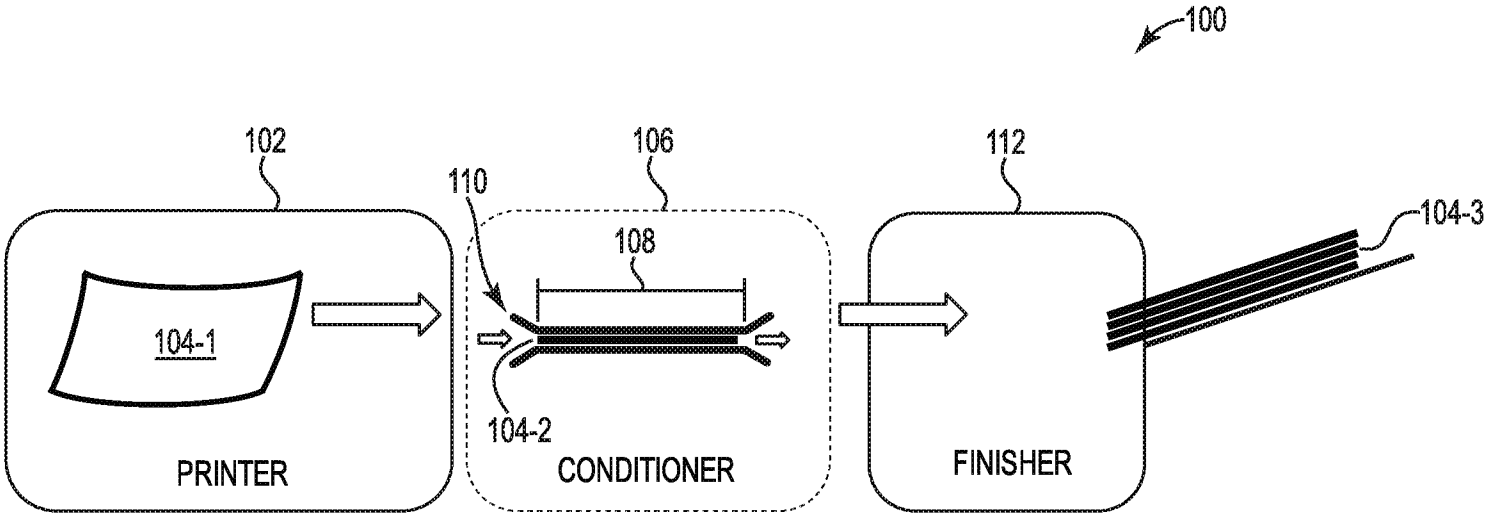
FIG. 1 illustrates an example system for a partially dried inkjet media conditioner consistent with the present disclosure.

A number of systems and devices for a partially dried inkjet media conditioner are described herein. In some examples, a system for a partially dried inkjet media conditioner can include a partially dried inkjet media conditioner, comprising: a first connector to couple a first end of the conditioner to a printing device, a second connector to couple a second end of the conditioner to a finishing device, and a constrained path extending through the conditioner to receive partially dried inkjet media from the printing device and provide the partially dried inkjet media to the finishing device. As used herein, partially dried inkjet media can include media with applied printing fluid from an inkjet type printing device that is not completely dried on the media.

The partially dried inkjet media can provide difficulties when stacking, aligning, and/or finishing. For example, the partially dried inkjet media can have distorted properties such as a curl, a cockle, a reduction in stiffness, increased surface roughness, extruding fibers from the surface, misaligned fibers, and/or increased sheet to sheet friction of the media. In some examples, these distorted properties can be caused by printing fluid deposited on the media and the media absorbing the printing fluid. For example, the printing fluid can be in a liquid state that can be absorbed by a media such as paper. In this example, the liquid state of the printing fluid can cause the distorted properties of the media in a similar way that other liquids may distort the properties of the media.

The partially dried inkjet media conditioner as described herein can be coupled between a printing device and a finishing device to prepare the partially dried inkjet media for the finishing device. For example, the conditioner can include a constrained path to apply a pressure to the partially dried inkjet media. In this example the applied pressure of the constrained path can promote drying of the partially dried inkjet media. In some examples, the applied pressure of the constrained path can promote drying and a partial or complete restoration of the distorted properties caused by the printing fluid. For example, the applied pressure of the constrained path can restore a curl or cockle of the partially dried inkjet media to a relatively flatter position. In another example, the applied pressure of the constrained path can restore a stiffness and/or surface roughness of the partially dried inkjet media.

As described further herein, the partially dried inkjet media conditioner can receive partially dried inkjet media from a printing device and via a constrained path, the partially dried inkjet media conditioner can restore a number of the distorted properties of the partially dried inkjet media. In some examples, the partially dried inkjet media conditioner can be altered to restore the partially dried inkjet media based on a finishing device type. For example, different finishing devices can receive and perform a finishing process on media with a particular level of distorted properties.

The figures herein follow a numbering convention in which the first digit corresponds to the drawing figure number and the remaining digits identify an element or component in the drawing. Elements shown in the various figures herein may be capable of being added, exchanged, and/or eliminated so as to provide a number of additional examples of the present disclosure. In addition, the proportion and the relative scale of the elements provided in the figures are intended to illustrate the examples of the present disclosure, and should not be taken in a limiting sense.

FIG. 1 illustrates an example system 100 for a partially dried inkjet media conditioner 106 consistent with the present disclosure. In some examples, the system 100 can be utilized to prepare partially dried inkjet media 104-1 from a printer 102. In some examples, the system 100 can be utilized to prepare the partially dried inkjet media 104-1 for a finishing process performed by a finisher 112. In some examples, the partially dried inkjet media 104-1 can be prepared by a conditioner 106.

The system 100 can include a printer 102 that can generate partially dried inkjet media 104-1. As described herein, the printer 102 can be an inkjet printer that can deposit printing fluid (e.g., ink, etc.) on a media (e.g., paper, plastic, etc.). As described herein, the deposited printing fluid can create distorted properties such as a curl, a cockle, a reduction in stiffness, increased surface roughness, exposed fibers, and/or increased sheet to sheet friction of the partially dried inkjet media 104-1.

In some examples, the printer 102 can provide the partially dried inkjet media 104-1 to a conditioner 106. The conditioner 106 can be utilized to restore or partially restore a number of distorted properties of the partially dried inkjet media 104-1. In some examples, the conditioner 106 can include a constrained path 108. In some examples, the constrained path 108 can be utilized to apply pressure to partially dried inkjet media 104-2 while the partially dried inkjet media 104-2 is traveling through the constrained path 108. For example, the constrained path 108 can provide constraint within the constrained path 108, which can be realized by applying pressure to the partially dried inkjet media 104-2. In some examples, the constrained path 108 can apply pressure to partially dried inkjet media 104-2 when the partially dried inkjet media 104-2 is in a stationary position.

In some examples, the constrained path 108 can utilize a number of plates (e.g., top plate, bottom plate, etc.). In some examples, the number of plates can be adjusted based on an extent of the distorted properties of the partially dried inkjet media 104-2. For example, the printer 102 can deposit various quantities of printing fluid on the inkjet media depending on a number of features. In some examples, the number of features can include, but is not limited to: a type of printer, quality of an image produced by the printing fluid, whether printing fluid is deposited on a single side or both sides of the media, and/or type of printing fluid. In some examples, the number of plates of the constrained path 108 can be adjusted to apply a greater pressure on the partially dried inkjet media 104-2 when the extent of the distorted properties are greater. In some examples, the number of plates can be adjusted via a mechanical mechanism (e.g., actuator, etc.). In some examples, the constrained path 108 applies a pressure to a surface of the partially dried inkjet media 104-2. For example, the constrained path 108 can apply pressure by means of vacuum pressure being applied to the surface of the partially dried inkjet media 104-2. In another example, the constrained path 108 can apply pressure by means of positive pressure being applied to the surface of the partially dried inkjet media 104-2.

In some examples, the conditioner 106 can include a number of flared portions 110 to receive the partially dried inkjet media 104-2. The number of flared portions 110 can be portions of the conditioner 106 that have a relatively larger opening compared to the constrained path 108 to allow the partially dried inkjet media 104-2 to enter the constrained path 108 even when the partially dried inkjet media 104-2 includes a curl or cockle. For example, a curl in the partially dried inkjet media 104-2 can cause problems when inserting the partially dried inkjet media 104-2 without a flared portion 110 to help guide the curl of the partially dried inkjet media 104-2. In some examples, the number of flared portions 110 can be positioned at each end of the conditioner 106 to allow the conditioner 106 to more easily receive the partially dried inkjet media 104-2 from the printer 102 and to more easily provide the partially dried inkjet media 104-2 to the finisher 112. In some examples, the flared portions 110 can include a greater area compared to the constrained path.

In some examples, the constrained path 108 can be a particular distance based on the extent of the distorted properties of the partially dried inkjet media 104-2. For example, a particular printer 102 can cause a particular level of distorted properties to the partially dried inkjet media 104-2 and the distance of the constrained path 108 can be based on the particular level of the distorted properties. In some examples, the distance of the constrained path 108 can be based on capabilities of the finisher 112. For example, the distance of the constrained path 108 can be utilized to restore properties of the partially dried inkjet media 104-2 to a particular level such that the finisher 112 is capable of performing a number of finishing processes.

In some examples, the finisher 112 can receive the partially dried inkjet media 104-2 from the conditioner 106. In some examples, the finisher 112 can be coupled to an end of the conditioner 106. The finisher 112 can utilize the partially dried inkjet media 104-3 for a finishing process (e.g., stapling, hole punch, aligning, stacking, etc.). In some examples, the partially dried inkjet media 104-3 can include a number of restored properties compared to the partially dried inkjet media 104-1, 104-2.

Figure 2:
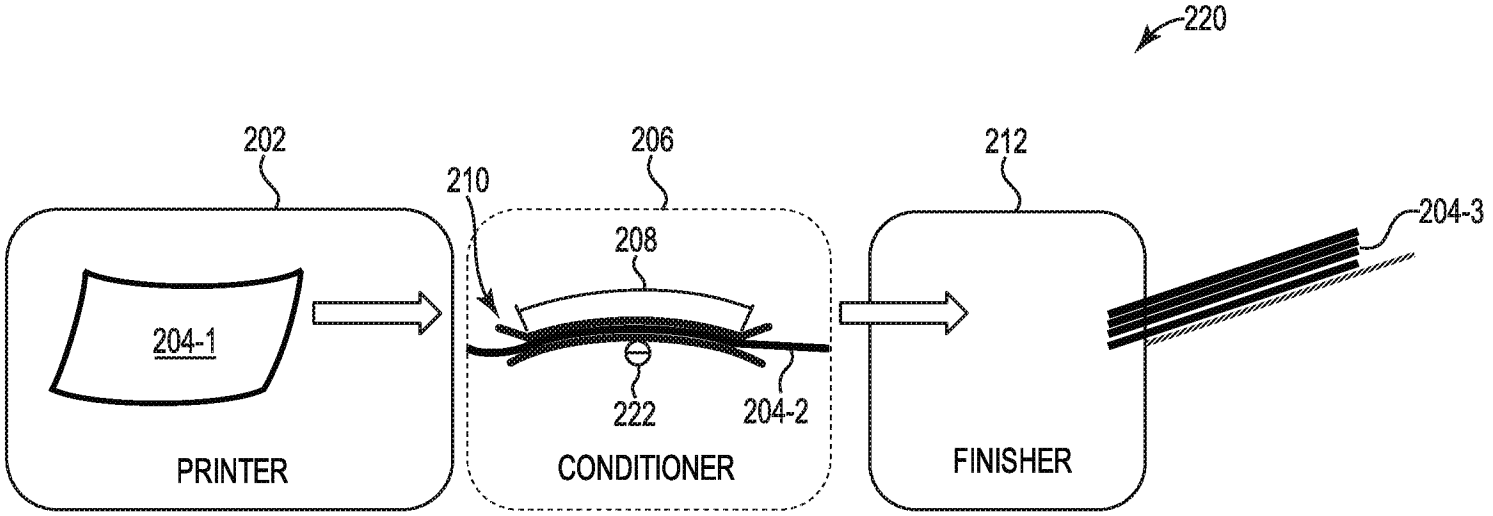
FIG. 2 illustrates an example system for a partially dried inkjet media conditioner consistent with the present disclosure.

FIG. 2 illustrates an example system 220 for a partially dried inkjet media conditioner 206 consistent with the present disclosure. In some examples, the system 220 can utilize a similar printer 202 and/or finisher 212 as printer 102 and finisher 112 as referenced in FIG. 1. For example, the printer 202 can be an inkjet printer that can deposit a printing fluid on a print media. As described herein, depositing the printing fluid can distort a number of properties of the print media.

As described herein, the printer 202 can generate partially dried inkjet media 204-1 that can be provided to a conditioner 206. The conditioner 206 can include a number of features that are the same or similar to the conditioner 106 as reference in FIG. 1. For example, the conditioner 206 can include a number of flared portions 210 to receive partially dried inkjet media 204-1 from the printer 202. As described herein, the number of flared portions 210 can help position the partially dried inkjet media 204-1 into a constrained path 208 even when the partially dried inkjet media 204-1 includes a curl or cockle.

In some examples, the constrained path 208 of the conditioner 206 can include a vacuum to apply a pressure to the partially dried inkjet media 204-2. In some examples, the constrained path 208 of the conditioner 206 can include a number of plates to apply a pressure to the partially dried inkjet media 204-2. As described herein, the applied pressure of the constrained path 208 can enhance drying and/or straightening of the partially dried inkjet media 206. For example, the applied pressure can restore a number of properties to the partially dried inkjet media 204-2. In some examples, a number of guides can be utilized to shape the constrained path 208 and direct the partially dried inkjet media 204-2 over a shaped constrained path (e.g., over constrained path, etc.).

In some examples, the constrained path 208 can be an over constrained path. For example, the over constrained path can be a portion of the constrained path 208 that includes an arch with a particular arch angle 222. In some examples, the arch angle 222 can be between approximately 5 and 10 degrees. In some examples, the arch radius of the constrained path 208 can be a distance between approximately 1 inch and 6 inches. In some examples, the over constrained path can be a reverse curl that can reduce the curl generated by the addition of the printing fluid to the partially dried inkjet media. For example, the over constrained path can be arched in a direction that is opposite to a curl direction of the partially dried inkjet media 204-2. In some examples, the over constrained path can be utilized to direct the partially dried inkjet media 204-2 to the finisher 212. For example, the over constrained path can direct the partially dried inkjet media 204-2 from the printer 202 to a relatively lower position of the finisher 212. In some examples, the constrained path 208 comprises an over constrained path that includes an arch that bends the partially dried inkjet media 204-2 within the constrained path 208.

As described herein, the partially dried inkjet media 204-2 can be provided to the finisher 212. In some examples, the partially dried inkjet media 204-3 at the finisher 212 can have a number of distorted properties of the partially dried inkjet media 204-1 restored or partially restored. In some examples, the partially dried inkjet media 204-3 can be suitable for performing a number of finishing processes executed by the finisher 212.

Figure 3:
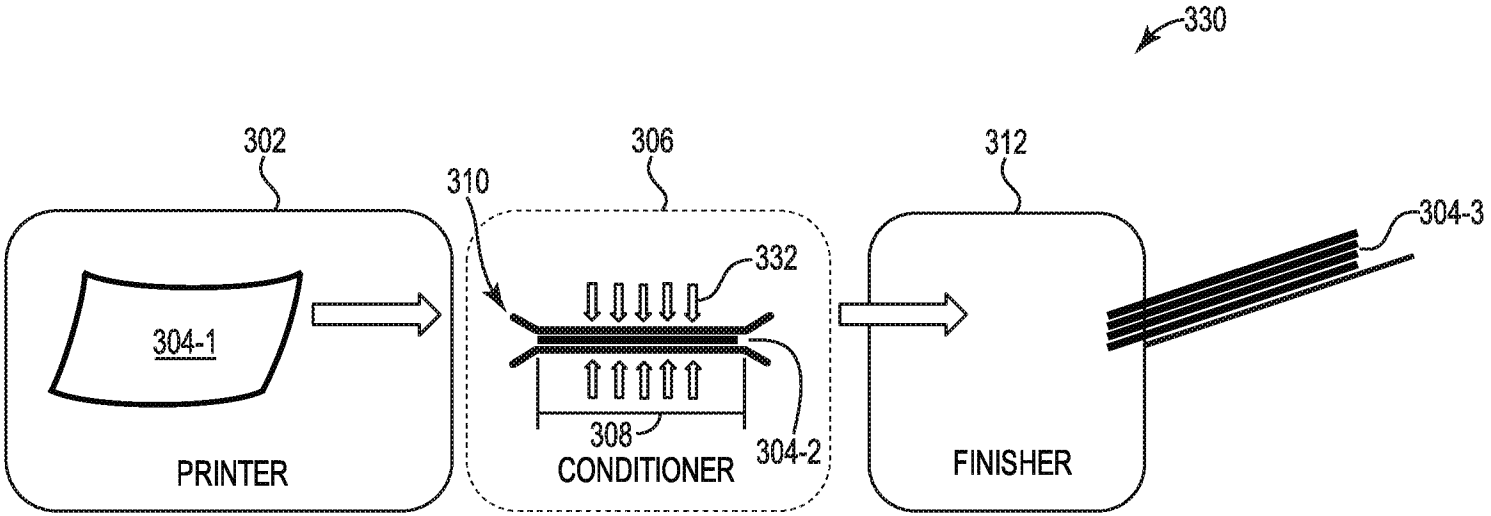
FIG. 3 illustrates an example system for a partially dried inkjet media conditioner consistent with the present disclosure.

FIG. 3 illustrates an example system 330 for a partially dried inkjet media conditioner 306 consistent with the present disclosure. In some examples, the system 330 can utilize a similar printer 302 and/or finisher 312 as printer 102 and finisher 112 as referenced in FIG. 1. For example, the printer 302 can be an inkjet printer that can deposit a printing fluid on a print media. As described herein, depositing the printing fluid can distort a number of properties of the print media, which can make it difficult to execute a finishing process.

As described herein, the printer 302 can generate partially dried inkjet media 304-1 that can be provided to a conditioner 306. The conditioner 306 can include a number of features that are the same or similar to the conditioner 106 as reference in FIG. 1 and/or the conditioner 206 as referenced in FIG. 2. For example, the conditioner 306 can include a number of flared portions 310 to receive partially dried inkjet media 304-1 from the printer 302. As described herein, the number of flared portions 310 can help position the partially dried inkjet media 304-1 into a constrained path 308 even when the partially dried inkjet media 304-1 includes a curl or cockle.

In some examples, the constrained path 308 of the conditioner 306 can include a vacuum to apply a pressure to the partially dried inkjet media 304-2. In some examples, the constrained path 308 of the conditioner 306 can include a number of plates to apply a pressure to the partially dried inkjet media 304-2. As described herein, the applied pressure of the constrained path 308 can enhance drying and/or straightening of the partially dried inkjet media 306. For example, the applied pressure can restore a number of properties to the partially dried inkjet media 304-2. In some examples, a heat source 332 can be utilized to increase a temperature of the constrained path 308. In some examples, increasing the temperature of the constrained path 308 can enhance evaporation and/or drying of the partially dried inkjet media 304-2.

In some examples, the heat source 332 can be applied to each side of the constrained path to provide heat to each side of the partially dried inkjet media 304-2. In some examples, the heat source 332 can include an air circulation device to remove moist air from the constrained path 308. Providing a heat source and an air circulation device can enhance evaporation and/or drying of the partially dried inkjet media 304-2. In some examples, the heat source 332 can produce heat to provide a temperature of the constrained path 308 that is approximately between 10 degrees and 50 degrees Celsius above an ambient temperature (e.g., room temperature, etc.) of the constrained path 308. In some examples, the air circulation device can push warm air from the heat source 332 on to the partially dried inkjet media while removing moist air from the constrained path 308 to promote evaporation and/or drying of the printing fluid deposited on the inkjet media.

In some examples, a combination of a constrained path, over constrained path, and/or a heat source 332 can be utilized together to restore a number of the distorted properties of the partially dried inkjet media 304-2. As described herein, the partially dried inkjet media 304-2 can be provided to the finisher 312. In some examples, the partially dried inkjet media 304-3 at the finisher 312 can have a number of distorted properties of the partially dried inkjet media 304-1 restored or partially restored. In some examples, the partially dried inkjet media 304-3 can be suitable for performing a number of finishing processes.

Figure 4:
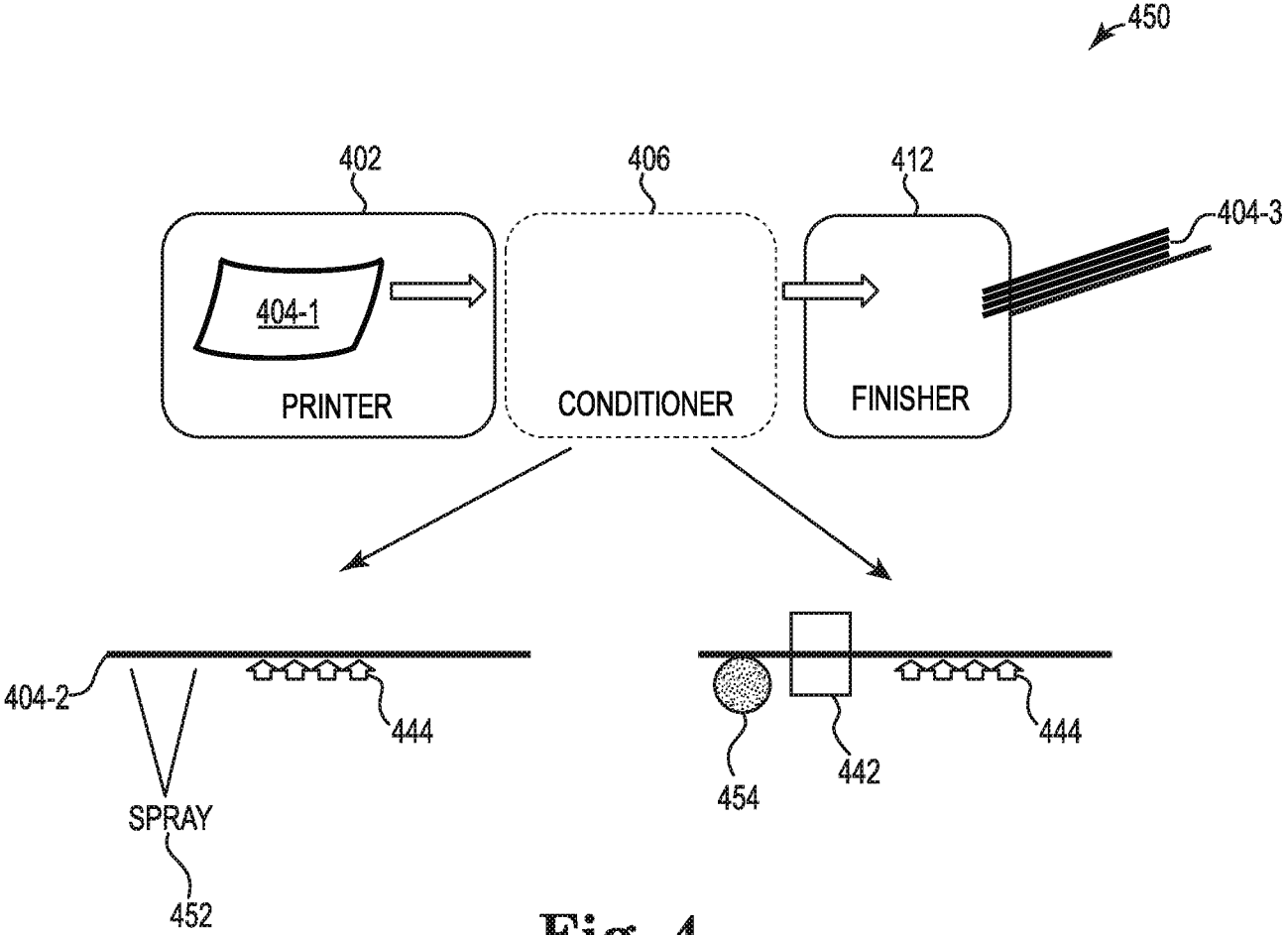
FIG. 4 illustrates an example system for a partially dried inkjet media conditioner consistent with the present disclosure.

FIG. 4 illustrates an example system 450 for a partially dried inkjet media conditioner consistent with the present disclosure. In some examples, the system 450 can utilize a similar printer 402 and/or finisher 412 as printer 102 and finisher 112 as referenced in FIG. 1. For example, the printer 402 can be an inkjet printer that can deposit a printing fluid on a print media. As described herein, depositing the printing fluid can distort a number of properties of the print media, which can make it difficult to execute a finishing process. In some examples, the printer 402 can provide partially dried inkjet media 404-1 to a conditioner 406 to restore a number of the properties.

In some examples, the conditioner 406 can receive partially dried inkjet media 404-2 from the printer 402. In some examples, the conditioner 406 can include a liquid depositor 452. In some examples, the liquid depositor 452 can generate a spray, film, and/or mist that can be utilized to deposit a liquid on to the partially dried inkjet media 404-2. In some examples, the liquid deposited by the liquid depositor 452 can include a substantially clear liquid. As used herein, a substantially clear liquid can include a liquid that when deposited on the partially dried inkjet media 404-2 is more clear than opaque. In some examples, the liquid deposited by the liquid depositor 452 can include, but is not limited to a polyurethane paint, a polyurethane toner, and/or a waxed based material.

In some examples, the liquid deposited by the liquid depositor 452 can be a liquid that can dry on the partially dried inkjet media at a rate that is relatively faster than the printing fluid applied by the printer 402. For example, the liquid deposited by the liquid depositor 452 can dry on the partially dried inkjet media 404-2 before the printing fluid is allowed to completely dry on the partially dried inkjet media 404-2. In some examples, the liquid deposited by the liquid depositor 452 can be a substantially clear coating material. That is, the liquid deposited by the liquid depositor 452 can be applied to a side of the partially dried inkjet media 404-2 with printing fluid deposited by the printer 402. In this example, the liquid deposited by the liquid depositor 452 can act as a coating to prevent the printing fluid from distorting properties of the partially dried inkjet media 404-2.

In some examples, the liquid deposited by the liquid depositor 452 can act as a coating over the side with deposited printing fluid when the liquid deposited by the liquid depositor 452 is dry. In some examples, the liquid can be selectively deposited in areas that correlate with area covered with partially dried printing fluid. In some examples, the liquid deposited by the liquid depositor 452 can act as a dried layer over the partially dried printing fluid of the partially dried inkjet media 404-2. In some examples, the liquid deposited by the liquid depositor 452 can provide structural support (e.g., lamination) for the partially dried inkjet media 404-2. For example, the liquid deposited by the liquid depositor 452 can dry and harden to prevent the printing fluid from distorting the number of properties of the inkjet media. In this example, the dry liquid deposited by the liquid depositor 452 can provide structural support and prevent the partially dried inkjet media from curling or cackling. In addition, the dry liquid deposited by the liquid depositor 452 can prevent fibers of the partially dried inkjet media 404-2 from being exposed or extruding from the surface of the partially dried inkjet media 404-2.

In some examples, the dry liquid deposited by the liquid depositor 452 can create a relatively lower friction surface compared to the partially dried inkjet media 404-2 without the liquid deposited by the liquid depositor 452. As described herein, the printing fluid deposited by the printer 402 can distort the surface friction of the partially dried inkjet media 404-2. In some examples, the printing fluid can create a relatively high friction surface of the partially dried inkjet media 404-2. By lowering the friction surface of the partially dried inkjet media 404-2, the liquid deposited by the liquid depositor 452 can reduce the distorted properties caused by the printing fluid. In some examples, the dry liquid deposited by the liquid depositor 452 can be a coating that can alter the properties of the partially dried inkjet media 404-2 such that the partially dried inkjet media 404-2 appears warm, dry, flat, and/or non-tacky.

In some examples, the dry liquid deposited by the liquid depositor 452 can create an air tight or substantially air tight seal over the printing fluid deposited on the partially dried inkjet media 404-2. In some examples, the dry liquid deposited by the liquid depositor 452 can create a substantially air tight seal over the printing fluid deposited on the partially dried inkjet media 404-2 such that the moisture associated with the printing fluid is evaporated through an opposite side of the partially dried inkjet media 404-2. For example, the liquid deposited by the liquid depositor 452 can be deposited on a printed side (e.g., side with deposited printing fluid) and force the moisture associated with the printing fluid to evaporate on a non-printed side of the partially dried inkjet media 404-2.

In some examples, the conditioner 406 can include a number of additional conditioning processes 444. For example, the number of additional conditioning processes 444 can include a heating process to cure the liquid deposited by the liquid depositor 452. In another example, the number of additional conditioning processes 444 can include a constrained path, an over constrained path, application of ultraviolet light, reaction catalyst, and/or a heated constrained path. In some examples, a heating process can be utilized to cure the liquid deposited by the liquid depositor 452. In some examples, a heating process can be utilized to dry the liquid deposited by the liquid depositor 452 faster than if a heating process were not utilized.

In some examples, liquid (e.g., liquid deposited by the liquid depositor 452, etc.) can be deposited by a roller 454. In some examples, the roller 454 can be in contact with a side of the partially dried inkjet media 404-2. In these examples, the roller 454 can apply a film coating of the liquid across the side of the partially dried inkjet media 404-2. In these examples, the side of the partially dried inkjet media 404-2 that the liquid is applied can be the same side as printing fluid is deposited by the printer 402.

In some examples, the conditioner 406 can include a toner application system 442. In some examples, the toner application system 442 can be utilized to apply a toner and/or liquid to the partially dried inkjet media 404-2. In some examples, the toner application system 442 can be utilized to bond the liquid applied by the roller 454 to the partially dried inkjet media 404-2. In some examples, the toner application system 442 can be utilized to apply heat to the partially dried inkjet media 404-2 to cure the liquid applied by the roller 454.

In some examples, the system 450 can utilize a conditioner 406 to apply a liquid to the partially dried inkjet media 404-2. In some examples, the liquid can maintain and/or restore a number of properties of the partially dried inkjet media 404-2. In some examples, the conditioner 406 can restore properties of the partially dried inkjet media 404-2 such that the finisher 412 can perform a finishing process on the partially dried inkjet media 404-3.

Figure 5:
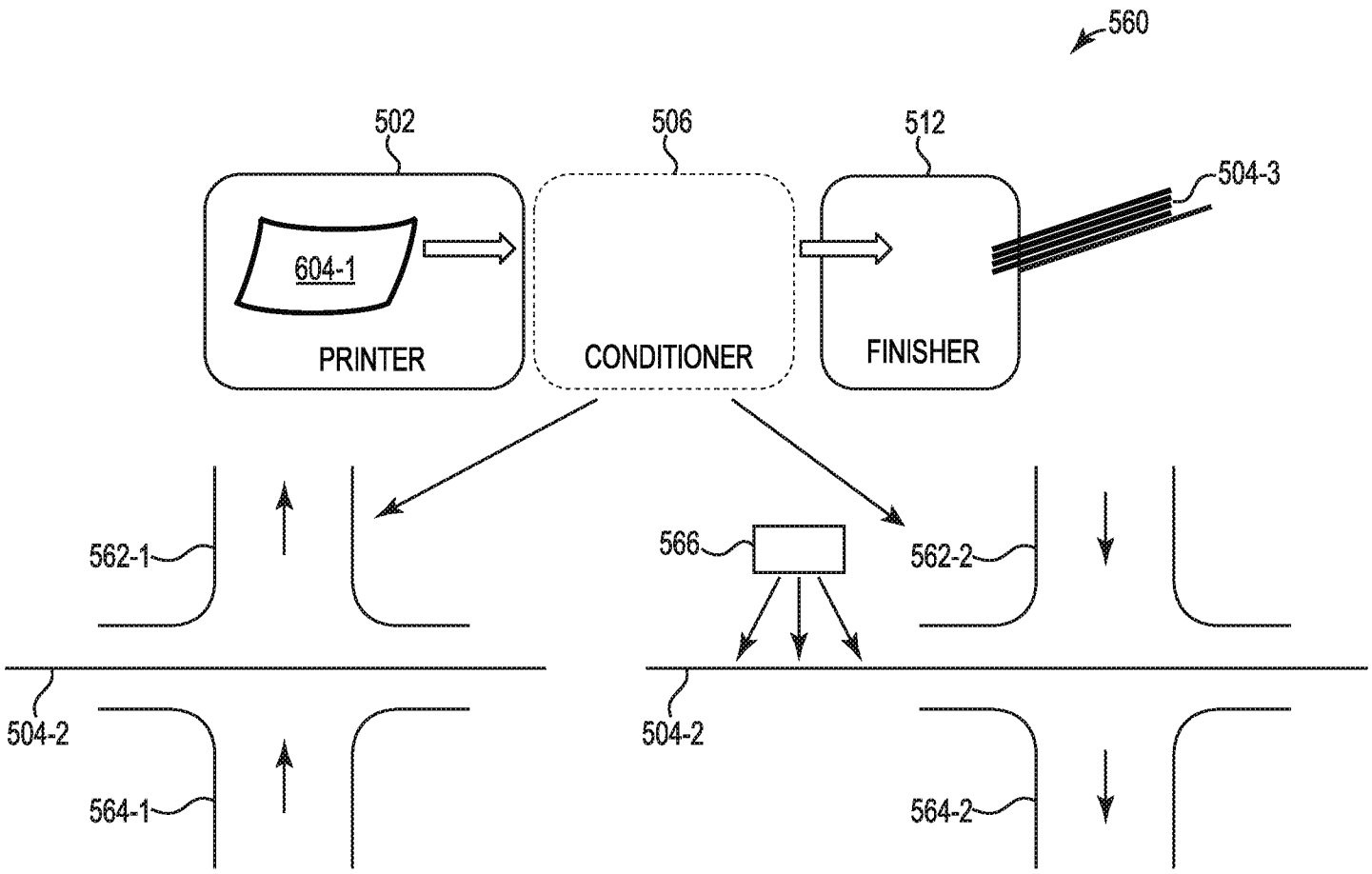
FIG. 5 illustrates an example system for a partially dried inkjet media conditioner consistent with the present disclosure.

FIG. 5 illustrates an example system 560 for a partially dried inkjet media conditioner consistent with the present disclosure. In some examples, the system 560 can utilize a similar printer 502 and/or finisher 512 as printer 102 and finisher 112 as referenced in FIG. 1. For example, the printer 502 can be an inkjet printer that can deposit a printing fluid on a print media. As described herein, depositing the printing fluid can distort a number of properties of the print media, which can make it difficult to execute a finishing process. In some examples, the printer 502 can provide partially dried inkjet media 504-1 to a conditioner 506 to restore a number of the properties.

In some examples, the conditioner 506 can include a number of curing devices 562-1, 562-2, 564-1, 564-2. In some examples, the number of curing devices can deposit curing agents on the partially dried inkjet media 504-2. In some examples, the number of curing devices 562-1, 562-2, 564-1, 564-2 can remove substances from the partially dried inkjet media 504-2. In some examples, the number of curing devices 562-1, 562-2, 564-1, 564-2 can function in combination to restore or partially restore a number of distorted properties of the partially dried inkjet media 504-2. For example, the curing device 562-1 can function in combination with one or more of the other curing devices 562-2, 564-1, 564-2.

In one example, the curing device 562-1 can be utilized to create a vacuum to pull moisture from the partially dried inkjet media 504-2. In some examples, the curing device 562-1 can be utilized to create a vacuum to pull moisture from a printed side of the partially dried inkjet media 504-2 when the printed side of the partially dried inkjet media 504-2 is on an opposite side of the curing device 562-1. In some examples, the curing device 562-1 can remove moisture from the area surrounding the partially dried inkjet media 504-2 to increase a rate of drying the printing fluid deposited on the partially dried inkjet media 504-2. In some examples, increasing the rate of drying the printing fluid deposited on the partially dried inkjet media 504-2 can prevent or substantially prevent a number of properties from becoming distorted.

In another example, the curing device 564-1 can be utilized to generate heat. In some examples, the curing device 564-1 can be a heating device to apply the generated heat on the partially dried inkjet media 504-2. In some examples, the heat can be applied to a side of the partially dried inkjet media 504-2 with printing fluid applied by the printer 502. In some examples, the applied heat from the curing device 564-1 can increase a rate of drying the printing fluid deposited on the partially dried inkjet media 504-2.

In another example, the curing device 562-1 can function in combination with curing device 564-1. In this example, the curing device 562-1 can be utilized to create a vacuum and the curing device 564-1 can be utilized to generate heat as described herein. In some examples, the combination of curing device 562-1 and curing device 564-1 can increase the rate of drying the printing fluid deposited on the partially dried inkjet media 504-2. In some examples, the curing device 664-1 can provide heat to the partially dried inkjet media 504-2, which can increase a quantity of moisture near a top side (e.g., non-printed side, side opposite of curing device 564-1, side opposite of deposited printing fluid, etc.). In these examples, the increased quantity of moisture near the top side of the partially dried inkjet media 504-2 can create distorted properties of the partially dried inkjet media as the printing fluid described herein. To prevent the increased quantity of moisture near the top side from distorting properties of the partially dried inkjet media 504-2, the curing device 564-1 can create a vacuum to remove the moisture from the top side of the partially dried inkjet media 504-2.

In another example, the conditioner 506 can include a liquid depositor 566. In some examples, the liquid depositor 566 can include a device that can spray a mist or liquid droplets of a liquid on the partially dried inkjet media 504-2. In some examples, the liquid depositor 566 can deposit the liquid on a non-printed side (e.g., side of partially dried inkjet media 504-2 without printing fluid applied by the printer 502, etc.) of the partially dried inkjet media 504-2. In some examples, the liquid depositor 566 can selectively deposit the liquid on a non-printed side (e.g., side of partially dried inkjet media 504-2 without printing fluid applied by the printer 502, etc.) of the partially dried inkjet media 504-2 to areas corresponding to the location of the printing fluid.

In some examples, the liquid deposited by the liquid depositor 566 can include water. In some examples, the liquid deposited by the liquid depositor 566 can be utilized to evenly deposit the liquid across the non-printed side of the partially dried inkjet media 504-2. In some examples, the liquid deposited by the liquid depositor 566 can allow each side of the partially dried inkjet media 504-2 to dry at a relatively similar rate. In some examples, the liquid deposited by the liquid depositor 566 can prevent or substantially prevent the properties of the partially dried inkjet media 504-2 from becoming distorted as described herein.

In some examples, the curing device 568-2 can be utilized to generate steam. In some examples, the steam generated by the curing device 568-2 can be generated by a liquid such as water. In some examples, a portion of the steam can be absorbed by the partially dried inkjet media 504-1. In some examples, the portion of the steam that is absorbed by the partially dried inkjet media can be absorbed on a non-printed side. In some examples, the absorbed steam can saturate the non-printed side of the partially dried inkjet media 504-2 such that the non-printed side and the printed side are substantially equally saturated. In some examples, the steam generated by the curing device 568-2 can be utilized to prevent the properties of the partially dried inkjet media 504-2 from becoming distorted as described herein.

In some examples, the curing device 562-2 can be utilized to generate heat. In some examples, the heat can be provided to a side of the partially dried inkjet media 504-2. In some examples, the heat provided by the curing device 562-2 can increase a drying rate of the printing fluid deposited by the printer 502. In some examples, the heat can be provided to a side of the partially dried inkjet media 504-2 that is opposite of a side with deposited printing fluid by the printer 502. In some examples, the heat provided to the side of the partially dried inkjet media 504-2 can create moisture to pass through the curing device 564-2. In some examples, the curing device 564-2 can be utilized to generate a vacuum as described herein to remove the moisture caused by the heat.

In some examples, the system 560 can utilize a conditioner 506 to perform a number of curing processes on the partially dried inkjet media 504-2. In some examples, the number of curing processes can maintain and/or restore a number of properties of the partially dried inkjet media 504-2. In some examples, the conditioner 506 can restore properties of the partially dried inkjet media 504-2 such that the finisher 512 can perform a finishing process on the partially dried inkjet media 504-3.

Figure 6:
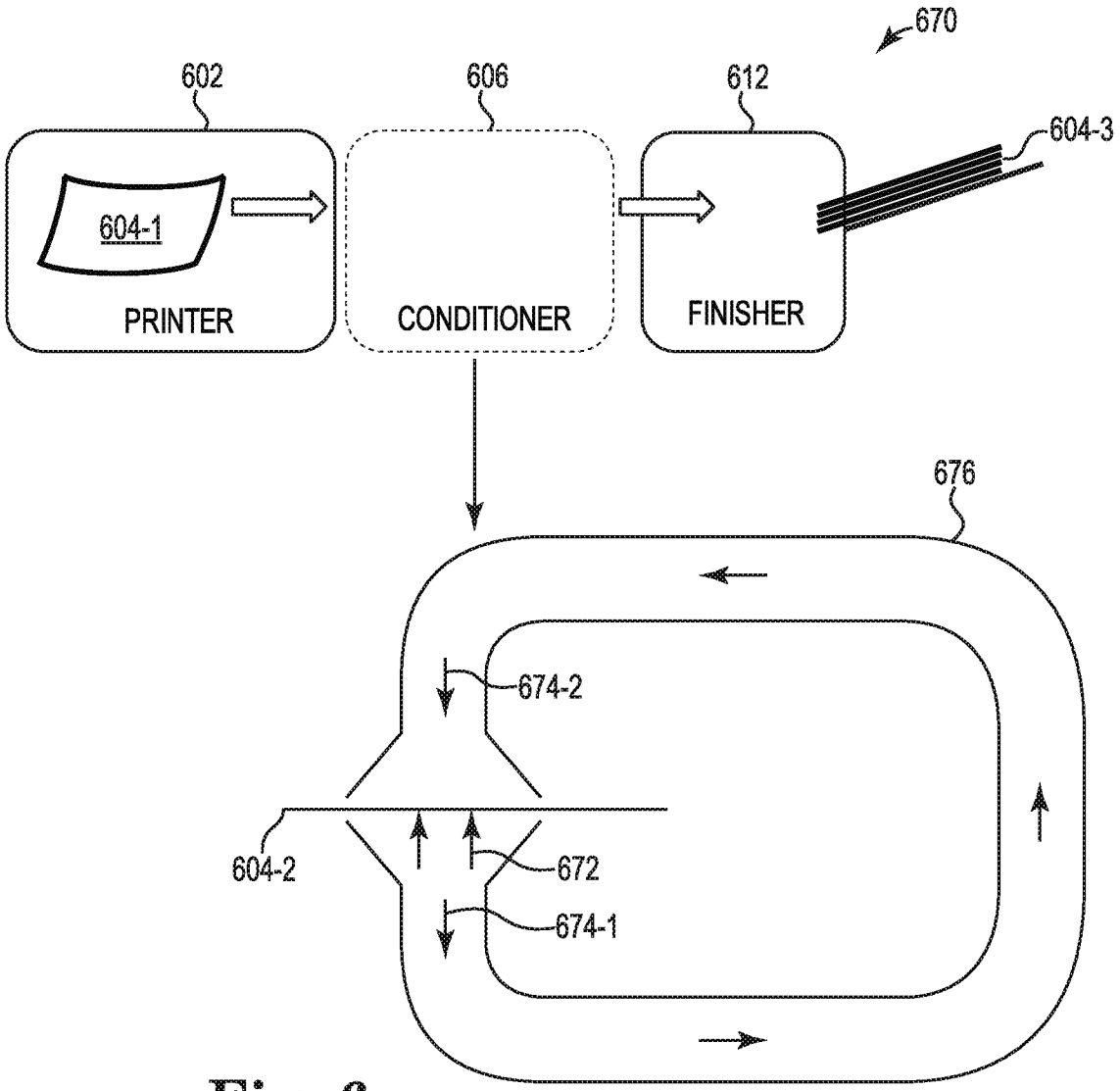
FIG. 6 illustrates an example system for a partially dried inkjet media conditioner consistent with the present disclosure.

FIG. 6 illustrates an example system 670 for a partially dried inkjet media conditioner consistent with the present disclosure. In some examples, the system 670 can utilize a similar printer 602 and/or finisher 612 as printer 102 and finisher 112 as referenced in FIG. 1. For example, the printer 602 can be an inkjet printer that can deposit a printing fluid on a print media. As described herein, depositing the printing fluid can distort a number of properties of the print media, which can make it difficult to execute a finishing process. In some examples, the printer 602 can provide partially dried inkjet media 604-1 to a conditioner 606 to restore a number of the properties.

In some examples, the conditioner 606 can include a number of curing devices 674-1, 674-2 that are coupled together via a connector 676. In some examples, the connector 676 can include a ducting material that can be utilized to transfer moisture from evaporated printing fluid to the curing device 674-1. In some examples, the curing device 674-1 can include a heating device 672 to apply heat on the partially dried inkjet media 604-2. As described herein, the applied heat from the heating device 672 can generate moisture due to the evaporation of printing fluid deposited by the printer 602. In some examples, the moisture can be collected by the curing device 674-1 and transferred through the connector 676 to curing device 674-1. In some examples, the moisture can be transferred through the connector 676 via a mechanical device (e.g., fan, exhaust fan, etc.).

In some examples, the moisture transferred moisture from the evaporated printing fluid can be utilized to apply moisture to an opposite side of the partially dried inkjet media 604-2 via the curing device 674-2. As described herein, the moisture applied by the curing device 674-2 can be absorbed by the partially dried inkjet media 604-2. In some examples, the absorbed moisture can be substantially evenly distributed across the non-printed side of the partially dried inkjet media 604-2. In some examples, absorbed moisture can be utilized to prevent properties of the partially dried inkjet media 604-2 from being distorted as described herein.

In some examples, the system 670 can utilize a conditioner 606 to perform a number of curing processes on the partially dried inkjet media 604-2. In some examples, the number of curing processes can maintain and/or restore a number of properties of the partially dried inkjet media 604-2. In some examples, the conditioner 606 can restore properties of the partially dried inkjet media 604-2 such that the finisher 612 can perform a finishing process on the partially dried inkjet media 604-3.

The above specification, examples and data provide a description of the method and applications, and use of the system and method of the present disclosure. Since many examples can be made without departing from the spirit and scope of the system and method of the present disclosure, this specification merely sets forth some of the many possible example configurations and implementations.

What is claimed:

1. A partially dried inkjet media conditioner, comprising:

a first connector to couple a first end of the conditioner to a printing device;

a second connector to couple a second end of the conditioner to a finishing device; and a constrained path extending through the conditioner to receive partially dried inkjet media from the printing device and provide the partially dried inkjet media to the finishing device, wherein the constrained path applies pressure by means of vacuum pressure to the partially dried inkjet media in response to the partially dried inkjet media being in a stationary position.

2. The conditioner of claim 1, wherein the first end of the conditioner and the second end of the conditioner include a flared portion.

3. The conditioner of claim 2, wherein the flared portion includes a greater area compared to the constrained path.

4. The conditioner of claim 1, comprising a liquid depositor to deposit a coating material on the partially dried inkjet media.

5. The conditioner of claim 1, wherein the constrained path is an over constrained path and wherein the over constrained path includes an arch between a portion of the first end of the conditioner and the second end of the conditioner.

6. A system for a partially dried inkjet media conditioner, comprising:

a conditioner to receive partially dried inkjet media from a printing device that is coupled to the conditioner, wherein the conditioner comprises a constrained path to alter a number of physical properties to the partially dried inkjet media by applying pressure by means of vacuum pressure to the partially dried inkjet media in response to the partially dried inkjet media being in a stationary position;

a heat source to apply heat to the constrained path; and a finisher coupled to the conditioner to receive the partially dried inkjet media from the conditioner.

7. The system of claim 6, wherein the conditioner includes a fuser to distribute a coating material across the partially dried inkjet media.

8. The system of claim 6, wherein the constrained path includes a vacuum to apply a constraint on the partially dried inkjet media.

9. The system of claim 6, wherein the constrained path comprises an over constrained path that includes an arch that bends the partially dried inkjet media within the constrained path.

10. The system of claim 6, wherein the constrained path applies a pressure to a surface of the partially dried inkjet media.

11. The system of claim 10, wherein the applied pressure of the constrained path alters the number of physical properties based on a number of properties of the finisher.

12. A system for a partially dried inkjet media conditioner, comprising:

a conditioner comprising a constrained path between a first connector and a second connector, wherein the constrained path applies a pressure by means of vacuum pressure to partially dried inkjet media passing through the constrained path in response to the partially dried inkjet media being in a stationary position;

a printing device coupled to the first connector to provide partially dried inkjet media to the conditioner; and a finishing device coupled to the second connector to receive the partially dried inkjet media from the conditioner.

13. The system of claim 12, wherein the conditioner includes a first curing device coupled to a second curing device by a connector.

14. The system of claim 13, wherein the first curing device receives moisture from evaporated printing fluid and the second curing device applies the moisture to the partially dried inkjet media.

15. The system of claim 12, wherein the conditioner includes a curing device to generate a vacuum over a non-printed side of the partially dried inkjet media.

* * * * *